US007448742B2

(12) United States Patent
Shaw

(10) Patent No.: US 7,448,742 B2
(45) Date of Patent: Nov. 11, 2008

(54) REUSABLE CARTRIDGE FOR INKJET PRINTER

(76) Inventor: Raymond D. Shaw, 9612 Lurline Ave. Unit C, Chatsworth, CA (US) 91311

( * ) Notice: Subject to any disclaimer, the term of this patent is extended or adjusted under 35 U.S.C. 154(b) by 334 days.

(21) Appl. No.: 11/212,324

(22) Filed: Aug. 25, 2005

(65) Prior Publication Data

US 2006/0055748 A1 Mar. 16, 2006

Related U.S. Application Data

(60) Provisional application No. 60/614,188, filed on Sep. 29, 2004.

(51) Int. Cl.
*B41J 2/175* (2006.01)

(52) U.S. Cl. ..... 347/93; 347/86

(58) Field of Classification Search ..... 347/86, 347/87, 93, 50; 137/549; 210/234; 156/272.8; 55/498

See application file for complete search history.

(56) References Cited

U.S. PATENT DOCUMENTS 5,390,701 A * 2/1995 Lessley et al. ..... 137/549
5,537,136 A * 7/1996 Brandon et al. ..... 347/87
5,657,065 A * 8/1997 Lin ..... 347/93
6,199,979 B1 * 3/2001 Hobson et al. ..... 347/93
6,234,622 B1 * 5/2001 Liu et al. ..... 347/93
6,328,424 B1 * 12/2001 Denton et al. ..... 347/50
6,398,354 B1 * 6/2002 Lattuca et al. ..... 347/93
6,398,838 B1 * 6/2002 Kaffenberger ..... 55/498
6,926,827 B2 * 8/2005 Gruca et al. ..... 210/234
6,986,571 B2 * 1/2006 Dudenhoefer et al. ..... 347/93
6,998,008 B2 * 2/2006 Kwan et al. ..... 156/272.8
2005/0099472 A1 * 5/2005 Kerr et al. ..... 347/86

* cited by examiner

*Primary Examiner*—Stephen D Meier
*Assistant Examiner*—Carlos A Martinez, Jr.
(74) *Attorney, Agent, or Firm*—Elliott N. Kramsky

(57) ABSTRACT

A cartridge for an inkjet printing apparatus. A case of molded plastic includes a downwardly-projecting nose section. An opening in the bottom of the nose section is surrounded by an upstanding stand pipe internal to the cartridge. An insert holds a filter and includes a tube section and an upper flange. The insert is selectively removably fixed to the stand pipe to permit ready filter replacement and thereby facilitate reliable recharging of the cartridge.

14 Claims, 2 Drawing Sheets

REUSABLE CARTRIDGE FOR INKJET PRINTER

REFERENCE TO RELATED APPLICATION

The Present application claims priority of Provisional Patent Application 60/614,188 of Raymond Shaw covering "Press in #82" filed Sep. 29, 2004 in the United States Patent and Trademark Office.

BACKGROUND

1. Field of the Invention

The present invention relates to cartridges for storing ink. More particularly, this invention pertains to a reusable cartridge that is suitable for use with non-water soluble printer ink.

2. Description of the Prior Art

Inkjet technology provides a more-or-less ubiquitous alternative to other commonly employed technologies (e.g. laser) over a broad spectrum of document imprinting applications. Common and well-recognized applications of this technology include computer printers and facsimile machines. Inkjet printing advantageously produces documents that are not subject to the fading observed with other technologies such as laser printers.

Such technology involves the selective, patterned heating of ink contained within a cassette for controlled dispersion onto a sheet of paper. A representative cartridge for an inkjet printer is disclosed, for example, in U.S. Pat. No. 6,328,424 of Gary Allen Denton et al. titled "Inkjet Cartridge With Simultaneous Electrical and Fluid Connections". Such patent teaches a refillable cartridge that includes a foam-filled ink reservoir. A filter of mesh-like composition is provided between the foam-filled reservoir and a standpipe that forms a lower reservoir. The filter eliminates air bubbles that would otherwise degrade the printing process. The ink moves from the foam-filled reservoir through the standpipe into a chamber or "lower reservoir" wherein it may be selectively heated by an arrangement of heaters to cause the ink to be selectively thinned to permit passage, by capillary action, to a paper surface.

Recycling of inkjet cartridges is complicated by the necessary presence of the mesh-like filter. This is especially the case in the event that the ink stored in the cartridge is oil-based. Commonly, such a filter is either glued or laser welded to the open top of the stand pipe and the empty cartridge must be recharged with ink without its removal and replacement as such a process would be difficult and prohibitively expensive. As a result, the filter, often clogged with particles of contaminants and dried ink, is generally the cause of the abysmally low rate of success (generally about 40 per cent) of conventional cartridge recycling processes.

SUMMARY OF THE INVENTION

The preceding and other shortcomings of the prior art by providing a reusable cartridge for an ink jet printing apparatus. Such cartridge includes a case. The case has mutually orthogonal pairs of parallel planar walls defining the sides of an ink reservoir. A substantially planar cover is arranged to form the top of the case.

The bottom of the case comprises a planar floor and a downwardly-projecting nose section. An aperture is provided in the bottom of the nose section. An upright stand pipe interior to the nose section surrounds the opening. A removable insert is provided for selective affixation to the standpipe.

The insert includes a tube section for insertion into the stand pipe and an upper flange. A filter is located interior to the flange.

In a second aspect, the invention provides an insert for an inkjet cartridge case of the type that includes a downwardly-projecting nose section having an aperture with an upright stand pipe surrounding the aperture. Such insert includes a tube. An upper peripheral flange is provided. A filter is fixed within the peripheral flange.

In a third aspect, the invention provides a cartridge for an ink jet printing apparatus. Such cartridge includes a case that comprises mutually orthogonal pairs of parallel planar walls defining the sides of an ink reservoir.

A substantially planar cover forms the top of the case. A planar floor and a downwardly-projecting nose section comprise the bottom of the case. An aperture exists in the bottom of the nose section and an upright stand pipe is interior to the nose section surrounding the aperture.

A planar filter is fixed to the top of the stand pipe. The dimensions of the planar filter exceed those of the underlying stand pipe.

The preceding and other features of the invention will become further apparent from the detailed description that follows. Such description is accompanied by a set of drawing figures. Numerals of the drawing figures, corresponding to those of the written description, point to the features of the invention. Like numerals refer to like features throughout both the drawing figures and the written description.

DETAILED DESCRIPTION OF THE PREFERRED EMBODIMENT

Figure 1:
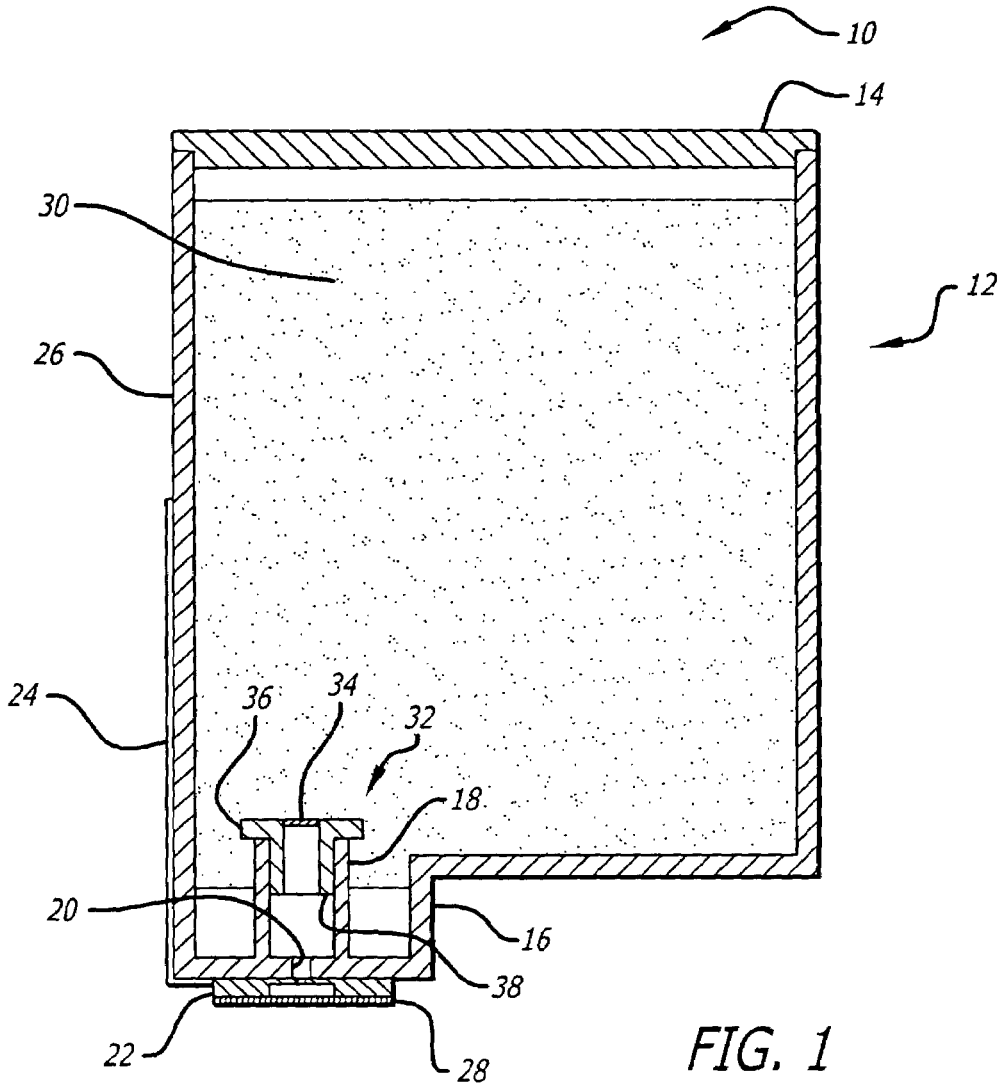
FIG. 1 is a cross-sectional view of a reusable inkjet cartridge in accordance with the invention.

FIG. 1 is a cross-sectional view of a reusable inkjet cartridge 10 in accordance with the invention. It includes a molded plastic body 12 of substantially hollow interior having a lid-like cover 14. The body 12 includes a downwardly-extending nose portion 16. A stand pipe 18 extends upwardly from the bottom of the nose portion 16.

A first aperture 20 extends through the bottom of the nose portion 16 of the molded plastic body 12. It provides a passageway for ink from the bottom of the stand pipe 18 to capillary ink passages within a heater chip 22 that is fixed to the bottom of the nose portion 16. A tab circuit 24 is fixed to the outer surface 26 of a cartridge body wall and extends underneath the nose portion 16 to make electrical contact with, and thereby control, the heater chip 22.

The tab circuit 24 comprises printed circuits whereby the heaters of the heater chip 22 are selectively connected to a source of energizing signals when the cartridge 10 is mounted on a cartridge carrier (not shown). As such heaters are selectively energized, ink, which is fast-drying, is ejected from the capillary passages within the heater chip 22 through apertures in a nozzle plate 28, thereby imprinting an underlying document.

Referring to additional details of the cartridge 10, a conventional hydrophobic foam material 30 (e.g. unfelted polyurethane open cell foam) fills a portion of the interior of the cartridge 10. Prior to placing the foam material 30 within the body 12, a filter insert 32 comprising a fine mesh screen 34 that is held by a molded frame comprising a peripheral flange 36 and upstanding tube section 38 is fitted to the stand pipe 18. The screen 34 prevents small particles of the foam material 30 form migrating through the stand pipe 18 and passage 20. Such migration could cause blockage of ink flow through the capillary ink passages within the heater chip 22. While the foam material 30 need not extend to the bottom of the stand pipe 18, it must extend downwardly to a level below the top of the stand pipe 18. Exemplary material for the screen 34 may comprise, but is not limited to, 316 stainless steel, 5 micron, 325×2300 twilled Dutch weave with wire size of 0.0014×0.0010 inch diameter. A screen 34 of round shape may be of 0.437 inch diameter.

The cartridge 10 is filled (and refilled) by insertion of a needle (not shown) into the foam material 30 (which is replaced and renewed when the cartridge is recycled) before the lid 14 is fixed to the cartridge body 12. Ink is injected into the foam material 30 through the needle to saturate it and to cause the stand pipe 18 to be filled with ink from an ink supply (not shown). A slight negative pressure is applied to the nozzle plate 28 to prime the cartridge 10 by drawing into the capillary ink passages of the heater chip 22.

In the prior art, the fine mesh screen 34 is fixed to the upper region of the stand pipe 18. As a consequence, when a cartridge is recycled or refilled it cannot be changed. As a consequence, the refilled cartridge is likely to be inoperable or to have a useful lifetime that is limited by the existence of accumulated foam debris on the filter screen. Further, the screen prevents accessing of the interior of the stand pipe at the bottom of the nose portion of the case. In the case of oil-based inks, an accumulation of hardened ink is likely to exist in this area, further limiting the useful life of the recharged cartridge.

Figure 2:
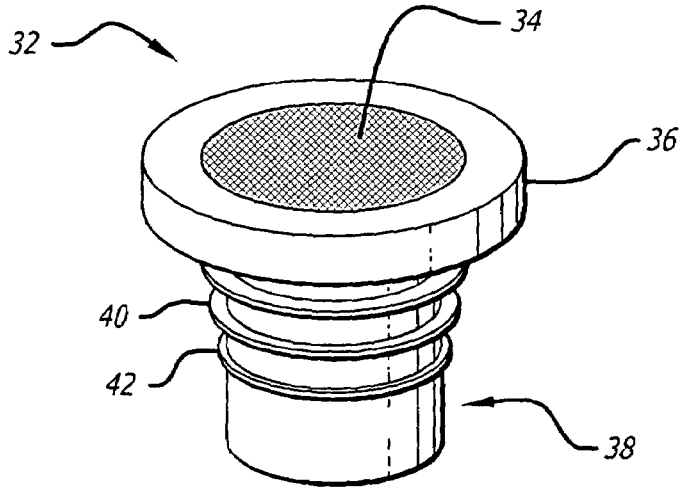
FIG. 2 is a perspective view of a filter insert in accordance with the invention.

This shortcoming is addressed in the present invention by utilizing the insert 32. FIG. 2 is a perspective view of an insert in accordance with the invention. As can be seen, the filter screen 34 is secured by any of a number of processes and means including, but not limited to, gluing or laser welding, to the interior of the peripheral flange 36. The upstanding tube section 38 is integral with the flange 36, the insert 32 preferably comprising a single molded piece for holding the filter screen 34.

A pair of ridges 40, 42 encircles and protrudes from the periphery of the cylindrical tube 38. They enable the insert 32 to be securely press-fit against the inner surface of the stand pipe 18.

Figure 3:
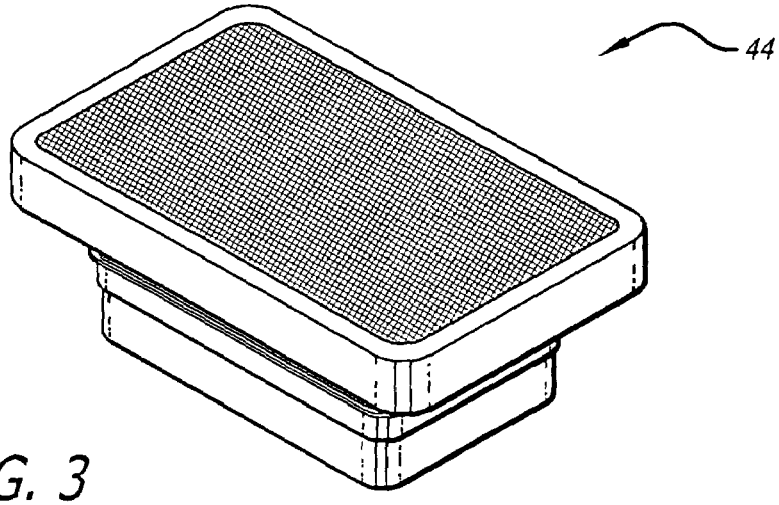
FIG. 3 is a perspective view of a filter insert in accordance with an alternative embodiment of the invention.

FIG. 3 is a perspective view of a filter insert 44 in accordance with an alternative embodiment of the invention. The embodiment of FIG. 3 differs from that of the preceding figures insofar as it is of generally-rectangular shape. In the case of the present embodiment and that of the preceding figures, the insert is shaped to conform to the shape of a stand pipe and accompanying filter-screen of a inkjet cartridge of standard design. That is, with the exception of the insert 32, all elements of the cartridge 10 of FIG. 1 are representative of a standard "off the shelf" device. In the event that an inkjet cartridge were to include a filter-screen that was conventionally directly fixed to the top of the stand pipe 18 (by, e.g., gluing or laser welding), such a cartridge may readily be converted to one in accordance with the invention by removal of the filter-screen and replacement with a filter insert in accordance with the invention.

Such replacement of a directly-affixed filter-screen with a filter insert is, in fact, contemplated in accordance with the invention. This enables and facilitates the recharging of such a conventional cartridge by enabling replacement of the filter-screen at the time of refilling of the cartridge. While appropriate tooling is contemplated for removal of a directly-fixed filter-screen, subsequent removals for replacement of the filter insert are much more routine. Thus, filter replacement may be accomplished through multiple refillings of an inkjet cartridge in accordance with the invention. Further, with each filter-screen insert removal, one obtains access to the interior of the stand pipe, allowing the clearance of dried ink before significant blockage can occur.

Figure 4:
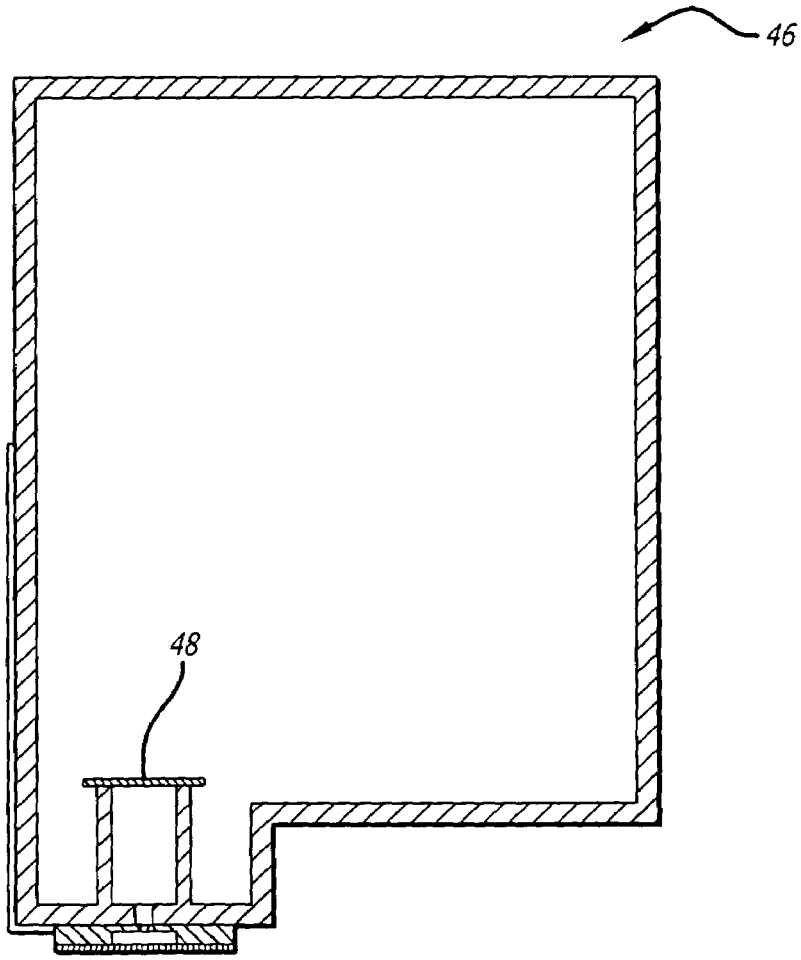
FIG. 4 is a side elevation view of an inkjet cartridge in accordance with a further embodiment of the invention.

FIG. 4 is a side elevation view of an inkjet cartridge 46 in accordance with a further embodiment of the invention. Unlike the embodiments of the preceding figures, a removable filter insert is not employed. Rather, a filter-screen 48 is directly fixed to the top of the stand pipe 18. The diameter of the circular filter-screen 48 is selected to exceed the outer diameter of the standpipe 18. In the event that the stand pipe were to be of generally-rectangular shape, the dimensions of the filter-screen would be selected to overlap the corresponding dimensions of the stand pipe. Appropriate composition and dimensions for a filter-screen 48 in accordance with this embodiment of the invention may comprise, but are not limited to, type 316L stainless steel, 325×2300 twilled Dutch weave, wire diameter 0.001×0.0010 of diameter 0.437 or 0.453 inch (round filter). A rectangular filter in accordance with the teachings of this embodiment may be, for example, 0.460 or 0.470×0.840 inches with 0.050 inch corner radii.

Thus it is seen that the present invention facilitates the refilling of an inkjet cartridge. By employing a cartridge in accordance with the invention, one may greatly enhance the useful life of a given cartridge by assuring its reliable refilling. Further, by utilizing a filter insert in accordance with the invention, one may simply convert a conventional or standard inkjet cartridge into a readily refillable device.

While the invention has been described with reference to its presently-preferred embodiment, it is not limited thereto. Rather, this invention is limited only insofar as it is defined by the following set of patent claims and includes within its scope all equivalents thereof.

What is claimed is:

1. A reusable cartridge for an ink jet printing apparatus comprising, in combination:

a) a case;

b) said case comprising mutually orthogonal pairs of parallel planar walls defining the sides of an ink reservoir;

c) a substantially planar cover forming the top of said case;

d) a planar floor and a downwardly-projecting nose section comprising the bottom of said case;

e) an aperture in the bottom of said nose section;

f) an upright stand pipe interior to said nose section surrounding said aperture;

g) a removable insert for selective affixation to said stand pipe;

h) said insert including a tube section for insertion into the stand pipe, said tube section having upper and lower ends, and an upper peripheral flange;

g) a filter being fixed within said peripheral flange;

h) a plurality of annular ridges arranged along and surrounding the exterior of said tube section;

i) each of said ridges being substantially orthogonal to the axis of symmetry of said tube section;

j) said ridges being substantially parallel to one another; and k) the outer diameters of said annular ridges being of decreased sizes from said upper end toward said lower end of said tube section.

2. The cartridge as defined in claim 1 wherein said filter comprises a metallic mesh.

3. The cartridge as defined in claim 2 wherein said insert is further characterized in that said tube section and said flange comprise an integral member.

4. The cartridge as defined in claim 3 further characterized in that:

a) said flange being annular; and b) said tube section being cylindrical.

5. The cartridge as defined in claim 3 further characterized in that each of said flange and said tube section being of generally rectangular shape.

6. The cartridge as defined in claim 3 wherein said filter is glued to said flange.

7. The cartridge as defined in claim 3 wherein said filter is laser welded to said flange.

8. An insert for an inkjet cartridge case of the type that includes a downwardly-projecting nose section having an aperture with an upright stand pipe surrounding the aperture, said insert comprising, in combination:

a) a tube section for directly sealing against said stand pipe, said tube section having upper and lower ends;

b) an upper peripheral flange;

c) a filter fixed within said peripheral flange;

d) a plurality of annular ridges arranged along and surrounding the exterior of said tube section;

e) each of said ridges having being substantially orthogonal to the axis of symmetry of said tube section;

f) said ridges being substantially parallel to one another; and g) the outer diameters of said annular ridges being of decreased sizes from said upper end toward said lower end of said tube section.

9. The insert as defined in claim 8 wherein said filter comprises a metallic mesh.

10. The insert as defined in claim 9 wherein said insert is further characterized in that said tube section and said flange comprise an integral member.

11. The insert as defined in claim 10 further characterized in that:

a) said flange being of annular shape; and b) said tube section being cylindrical.

12. The insert as defined in claim 10 further characterized in that each of said flange and said tube section being of generally rectangular shape.

13. The insert as defined in claim 10 wherein said filter is glued to said flange.

14. The insert as defined in claim 10 wherein said filter is laser welded to said flange.

* * * * *